United States Patent [19]

Coates, Jr. et al.

[11] 4,269,266

[45] May 26, 1981

[54] RECUPERATOR TUBE CONSTRUCTION

[75] Inventors: William R. Coates, Jr., Monroeville; M. William Vance, Export, both of Pa.

[73] Assignee: United States Steel Corporation, Pittsburgh, Pa.

[21] Appl. No.: 69,002

[22] Filed: Aug. 23, 1979

[51] Int. Cl.[3] ..... F28D 7/12

[52] U.S. Cl. ..... 165/142; 165/76; 165/160; 165/178; 266/155

[58] Field of Search ..... 165/76, 81, 82, 142, 165/155, 160, 162, 178, 180; 266/155; 126/109; 285/140

[56] References Cited

U.S. PATENT DOCUMENTS

| | | | |
|---|---|---|---|
| 1,726,020 | 8/1929 | Garvey | 165/142 |
| 2,841,383 | 7/1958 | Hazen | 165/142 |
| 2,937,855 | 5/1960 | Hazen | 165/142 |
| 3,220,713 | 11/1965 | Stookey | 165/160 |
| 3,309,072 | 3/1967 | Cummings | 165/76 |
| 3,319,709 | 5/1967 | Strunk | 165/142 |
| 3,403,726 | 10/1968 | Jones et al. | 165/142 |
| 3,407,870 | 10/1968 | Braune et al. | 165/155 |
| 3,446,277 | 5/1969 | White | 165/142 |
| 3,887,003 | 6/1975 | Pulcer et al. | 165/142 |
| 4,106,556 | 8/1978 | Heyn et al. | 165/142 |

*Primary Examiner*—Daniel J. O'Connor
*Attorney, Agent, or Firm*—John F. Carney

[57] ABSTRACT

A recuperator which includes vertically extending outer tubes and respective inner tubes within the outer tubes. Hot waste gases flow around the outside of the outer tubes. Air to be preheated flows through the inner tubes and annular passages between tubes. The outer tubes are formed of relatively short length sections of ceramic joined end-to-end. The lowermost sections rest on solid base blocks which support the weight of the outer tubes.

4 Claims, 2 Drawing Figures

RECUPERATOR TUBE CONSTRUCTION

Figure 1:
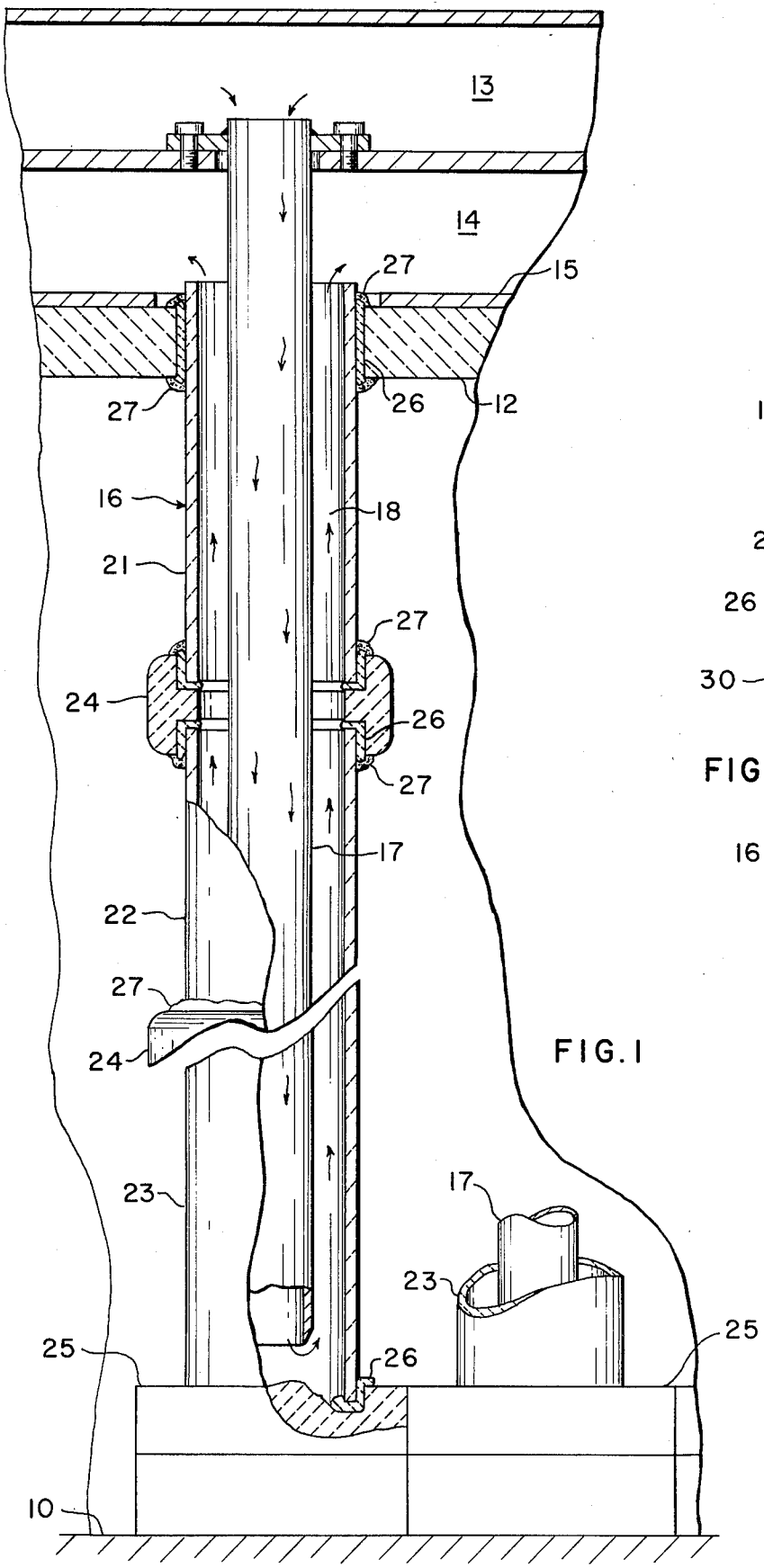

This invention relates to an improved recuperator tube construction, particularly for "Hazen" recuperators.

A conventional "Hazen" recuperator includes a plurality of vertically extending metal outer tubes closed at their lower ends and respective metal inner tubes open at both ends suspended within the outer tubes. Hot waste gases flow around the outside of the outer tubes. Usually combustion air to be preheated flows downwardly through the inner tubes and upwardly through the annular passages between tubes, although the direction of air flow may be reversed. Reference can be made to Hazen U.S. Pat. Nos. 2,841,383 or 2,937,855 for showings.

The outer tubes, particularly those in the region where the waste gases first enter the recuperator, are exposed to high temperatures, which adversely affect their life. It has been proposed to form recuperator tubes of ceramic, such as silicon carbide, which withstands high temperatures better than metal, as shown for example in Stookey U.S. Pat. No. 3,220,713, Cummings U.S. Pat. No. 3,309,072 or Heyn U.S. Pat. No. 4,106,556. Ceramic recuperator tubes used heretofore do not afford best advantages. The Stookey and Cummings patents show single tubes which are open at both ends and through which air flows in one direction only; hence their showings are not applicable to "Hazen" recuperators. The Heyn patent shows a recuperator similar to a "Hazen" recuperator, but which has integral ceramic tubes replacing both the outer and inner metal tubes.

An object of my invention is to provide a recuperator which embodies outer and inner tubes, the outer tubes being of ceramic, but in which the ceramic tubes are fabricated and installed more easily, and have improved support means.

A more specific object is to provide a recuperator of the foregoing construction in which the ceramic outer tubes are formed in sections joined end-to-end to facilitate fabrication and handling, and are supported at the bottom on solid base blocks.

Figure 2:
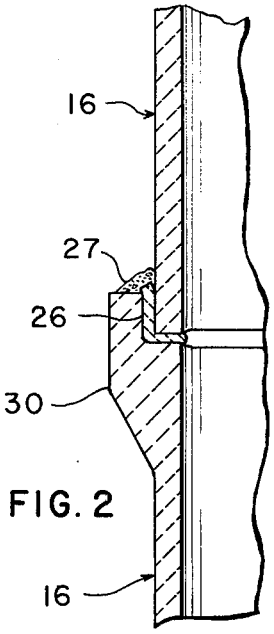

In the drawing:

FIG. 1 is a vertical sectional view of a portion of a recuperator which has tubes constructed in accordance with my invention; and FIG. 2 is a vertical sectional view of a modified form of outer tube within my invention.

FIG. 1 shows a portion of a recuperator which includes a floor 10 and a roof 12, both of suitable refractory, and cold and hot air plenum chambers 13 and 14 above the roof. Preferably a metal plate 15 overlies the roof. A plurality of outer and inner tubes 16 and 17 extend vertically downward from the roof. The inner tubes 17 are open at both ends and communicate with the cold air chamber 13 at their upper ends. The outer tubes 16 are closed at their lower ends and communicate with the hot air chamber 14 at their upper ends. Hot waste gases pass through the recuperator around the outside of the outer tubes 16. Cold air to be preheated enters the inner tubes 17 from the cold air chamber 13, flows downwardly through the inner tubes and upwardly through annular passages 18 between tubes, and discharges to the hot air chamber 14. The recuperator can be of conventional construction apart from the outer tubes and their support means hereinafter described; hence other parts are not shown in detail.

In accordance with my invention, each outer tube 16 is formed of a plurality of relatively short-length sections. The tubes illustrated have three such sections 21, 22 and 23. The sections are ceramic, preferably silicon carbide, but possible alternatives are high alumina, fireclay, fused silica or silicon nitride. Typically the outer tubes are over nine feet in length, and each section approximately three feet in length, but it is apparent the number and length of the sections may vary. Integral silicon carbide tubes of the required overall length not only are not readily obtainable, but would be too heavy for workmen to handle and install.

The uppermost section 21 extends through oversize holes in the roof 12 and plate 15. The joints between the middle section 22 and the uppermost and lowermost sections 21 and 23 include annular collars 24, preferably of the same ceramic as the sections. The lowermost section rests on a solid refractory base block 25 which supports the weight of the outer tube. The spaces (a) around the uppermost section 21 where it enters the roof 12, (b) within the collars 24, and (c) around the area of contact of the lowermost section 23 with the base block 25 are sealed with gaskets 26 which are vacuum formed or die cut ceramic fiber material, for example one of those available under the trademarks "Saffil", "Fiberfrax-H","Cerachrome", or "Kaowool 2600". Preferably these seals are covered with layers of mortar 27. As the outer tubes expand on heating, they compress the seals at the joints. Thus the joints are substantially leakproof.

FIG. 2 shows a modified construction in which the outer tube sections have integral collars 30. The joints are sealed in the same manner as in the embodiment shown in FIG. 1.

It is of course within my invention to construct all the outer tubes of the recuperator of ceramic as illustrated, but I prefer to use this construction only in the first few rows of tubes adjacent the location where the hot waste gases enter the recuperator. Conventional metal outer tubes have satisfactory life at other locations within the recuperator where the temperature is lower. Preferably the inner tubes throughout the recuperator are metal.

From the foregoing description, it is seen that my invention provides a ceramic tube which withstands high temperatures, but the ceramic is formed in sections easily handled. The outer tubes are closed at their lower ends and positively supported on solid base blocks.

We claim:

1. In a recuperator which includes a floor and a roof, cold air and hot air chambers above said roof, a plurality of vertically extending outer tubes and respective inner tubes within said outer tubes, said outer tubes being closed at their lower ends and communicating at their upper ends with one of said chambers, said inner tubes being open at both ends and communicating at their upper ends with the other of said chambers, the outside of said outer tubes being subject to exposure to hot waste gases to heat cold air passing through the tubes, the improvement in which:

said outer tubes comprise a plurality of relatively short length sections of ceramic joined end-to-end;

solid base blocks on said floor on which the lowermost of said sections rest to support the weight of the outer tubes;

the uppermost of said sections extending through said roof;

collars encircling the joints between sections; and gaskets of ceramic fiber material providing seals where the uppermost section extends through said roof, within said collars, and where the lowermost section contacts said base block.

2. An improvement as defined in claim 1 in which said seals are covered with mortar.

3. An improvement as defined in claim 1 in which said inner tubes are metal.

4. An improvement as defined in claim 1 in which only the tubes in the region where hot waste gases first enter the recuperator are constructed of ceramic.

* * * * *